US008066211B2

(12) United States Patent
Hagedorn et al.

(10) Patent No.: US 8,066,211 B2
(45) Date of Patent: Nov. 29, 2011

(54) CLOSED-CIRCUIT GRINDING PLANT HAVING SIFTER AND FINE MATERIAL SETTLING DEVICE

(75) Inventors: Alexander Hagedorn, Pulheim (DE); Meinhard Frangenberg, Kürten (DE)

(73) Assignee: KHD Humboldt Wedag GmbH, Cologne (DE)

( * ) Notice: Subject to any disclaimer, the term of this patent is extended or adjusted under 35 U.S.C. 154(b) by 0 days.

(21) Appl. No.: 12/681,903

(22) PCT Filed: Nov. 19, 2008

(86) PCT No.: PCT/EP2008/065855

§ 371 (c)(1),
(2), (4) Date: Apr. 7, 2010

(87) PCT Pub. No.: WO2009/068465

PCT Pub. Date: Jun. 4, 2009

(65) Prior Publication Data

US 2010/0219278 A1 Sep. 2, 2010

(30) Foreign Application Priority Data

Nov. 29, 2007 (DE) ..... 20 2007 016 785 U

(51) Int. Cl.
*B02C 23/14* (2006.01)

(52) U.S. Cl. ..... 241/75; 241/77; 241/79.1; 241/80; 241/143

(58) Field of Classification Search ..... 241/75, 241/77, 80, 79.1, 143
See application file for complete search history.

(56) References Cited

U.S. PATENT DOCUMENTS

2005/0284971 A1 12/2005 Hagedorn et al.

FOREIGN PATENT DOCUMENTS

| | | | |
|---|---|---|---|
| DE | 195 26 040 | A1 | 1/1997 |
| EP | 0614701 | A | 9/1994 |
| WO | WO 00/01488 | | 1/2000 |

*Primary Examiner* — Mark Rosenbaum
(74) *Attorney, Agent, or Firm* — Greer, Burns & Crain, Ltd.

(57) ABSTRACT

A closed-circuit grinding plant for grinding coarse material into a fine material, in particular for generating cement raw meal and/or cement from cement clinker, the plant having at least two roller presses disposed about a central riser shaft which pneumatically transports the fine material or pulverizing the coarse material, at least two sifters for separating the fine material generated during the pulverization from still existing coarse material, and at least two fine material settling devices for settling the fine material from the sifting air of the sifters.

10 Claims, 2 Drawing Sheets

CLOSED-CIRCUIT GRINDING PLANT HAVING SIFTER AND FINE MATERIAL SETTLING DEVICE

BACKGROUND OF THE INVENTION

The invention relates to a closed-circuit grinding plant for grinding coarse material into a fine material, in particular for generating cement raw meal and/or cement from cement clinker, the plant having at least one roller press for pulverizing the coarse material, at least one sifter for separating the fine material generated during the pulverization from the remaining coarse material, and at least one fine material settling device for settling the fine material from the sifting air of the sifter.

For the grinding of coarse material into a fine material, it is known to design closed-circuit grinding plants as vertical roll mills or as roller presses, the circuit of the material to be ground being generated by a bucket conveyor or other elevators. In the closed-circuit grinding plants, the fine material is separated from the coarse material by air sifters.

However, these plants are usually not scalable and have to be completely shut down for maintenance.

SUMMARY OF THE INVENTION

The object of the invention is to provide a closed-circuit grinding mechanism which is scalable and can be maintained during operation.

The closed-circuit grinding plant according to the invention is composed of more than one peripheral roller press which together form a roughly circularly symmetrical closed-circuit grinding system in the plane perpendicular to the vertical. In this case, individual roller presses can be deactivated during operation so as to allow the individual roller presses to be maintained. For this purpose, the feeding of material to be ground to the corresponding roller press is suspended and the closed-circuit grinding plant as a whole thus operates at reduced but not switched-off capacity.

The closed-circuit grinding plant according to the invention is easily scalable. The individual roller presses and their spares may be stocked as standardized individual parts.

In addition, the closed-circuit grinding plant according to the invention is suitable for replacing vertical roll mills, as their dimensions are comparable and, on account of a higher pressure in the roller nip compared to the pressure between the plate roller and the grindstone of a vertical roll mill, the capacity is greater than that of a vertical roll mill, as the number of revolutions of the material to be ground is reduced as a result of the higher nip pressure.

The grain size distribution of the ground fine material is also narrower as a result of the lower number of revolutions, leading to advantageous properties of the cement produced by the mill according to the invention.

BRIEF DESCRIPTION OF THE DRAWINGS

The invention will be described in greater detail with reference to the following figures, in which.

DETAILED DESCRIPTION OF THE DRAWINGS

Figure 1:
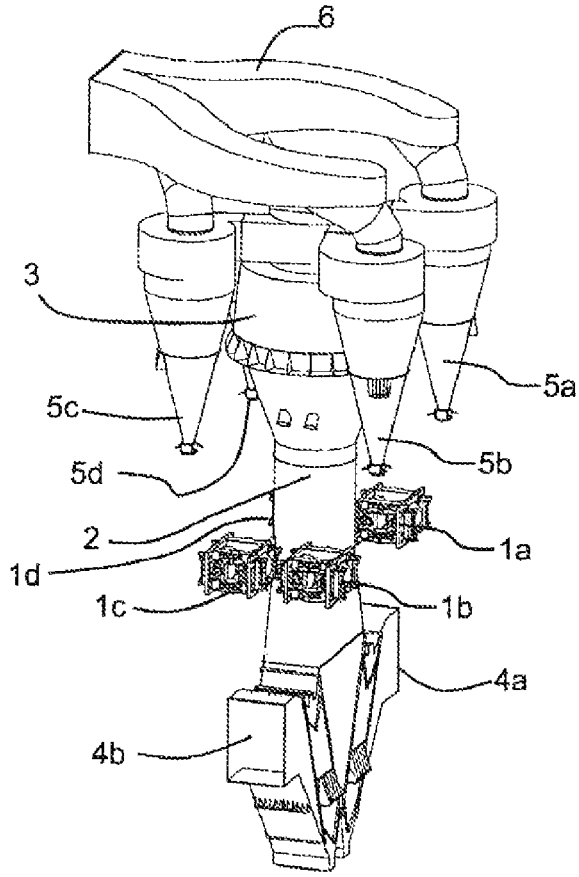
FIG. 1 shows a closed-circuit grinding plant according to the invention with four roller presses in a fourfold configuration.

FIG. 1 shows a closed-circuit grinding plant according to the invention having four roller presses 1*a*, 1*b*, 1*c* and 1*d* arranged symmetrically around a central riser pipe 2 for pneumatically conveying the circulating material to be ground.

Coarse material to be ground is fed into a central rod basket sifter 3 arranged above the roller presses 1*a*, 1*b*, 1*c* and 1*d* centrally on the riser pipe 2. The coarse material issues from the side of the rod basket sifter 3 and is passed using feeders (not shown here) to the roller mills 1*a*, 1*b*, 1*c* and 1*d*. There, the coarse material is pulverized and falls into the cascade sifters 4*a* and 4*b* below the roller presses 1*a*, 1*b*, 1*c* and 1*d* via feeders (not shown here). In the cascade sifters 4*a* and 4*b*, the coarse material is separated from the fine material, the coarse material issuing downward out of the cascade sifters 4*a* and 4*b* and the coarse material provided for a further revolution being transported back upward to the rod basket sifter 3 using an elevator (not shown). The fine material is, on the other hand, transported pneumatically through the central riser pipe 2 also into the rod basket sifter 3 and, from there, into the four cyclones 5*a*, 5*b*, 5*c* and 5*d*. There, the fine material is separated from the sifter air, and the sifter air purged of fine material leaves the closed-circuit grinding plant from the cyclones 5*a*, 5*b*, 5*c* and 5*d*. The sifter air is discharged through the collector 6 almost without dust.

Figure 2:
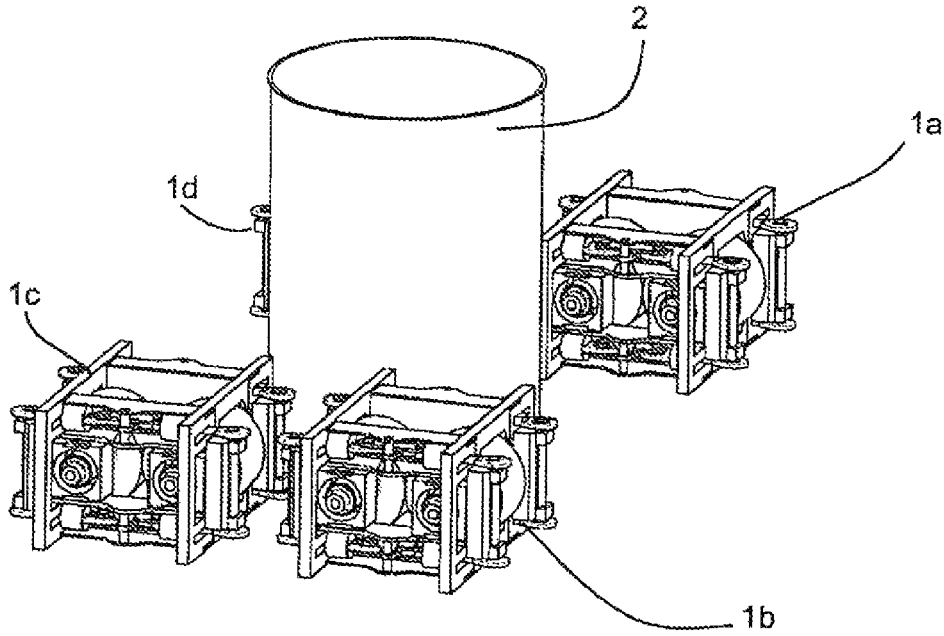
FIG. 2 is an enlarged detailed view of the roller presses and riser pipe of FIG. 1.

FIG. 2 is an enlarged detailed view of the roller presses 1*a*, 1*b*, 1*c* and 1*d* from FIG. 1.

Figure 3:
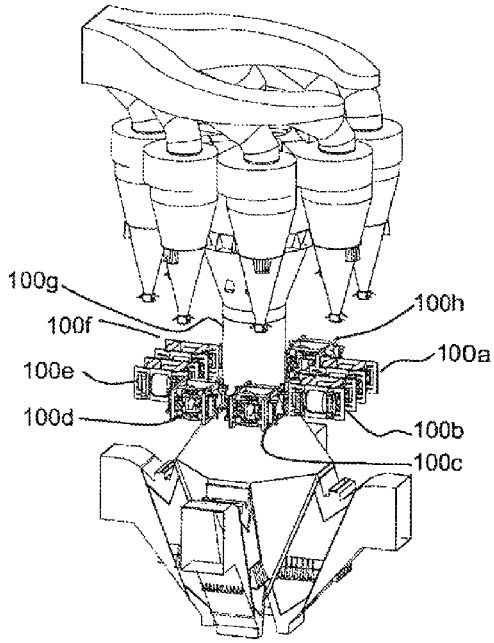
FIG. 3 shows a closed-circuit grinding plant according to the invention with four roller presses in an eightfold configuration.

FIG. 3 shows a closed-circuit grinding plant comparable to FIG. 1 but with eightfold symmetry.

Figure 4:
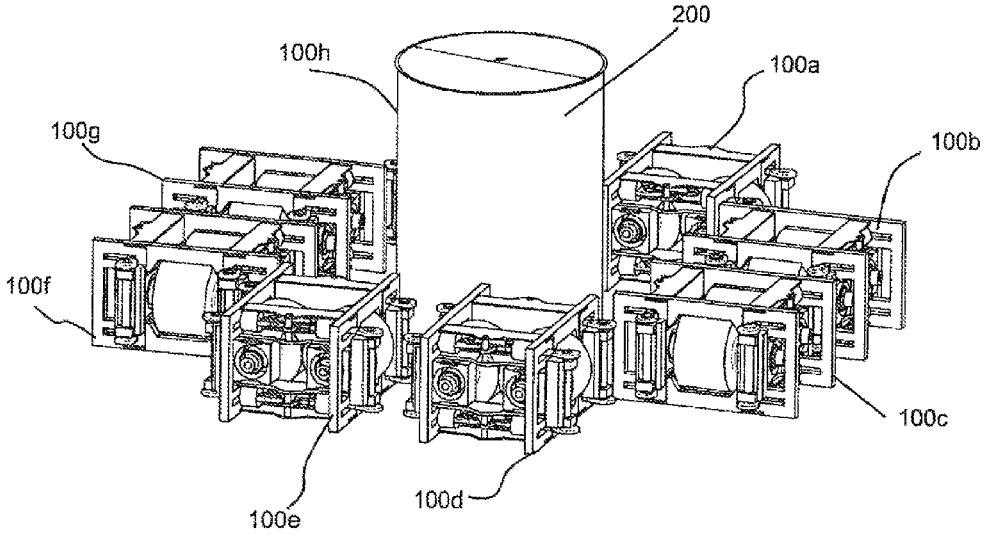
FIG. 4 is an enlarged detailed view of the roller presses and riser pipe of FIG. 3.

FIG. 4 is an enlarged detailed view of the roller presses 100*a*, 100*b*, 100*c*, 100*d*, 100*e*, 100*f*, 100*g* and 100*h* from FIG. 3.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A closed-circuit grinding plant for grinding coarse material into a fine material, the plant having at least one roller press for pulverizing the coarse material, at least one sifter for separating the fine material generated during the pulverization from the remaining coarse material, and at least one fine material settling device for settling the fine material from the sifting air of the sifter, the plant further comprising:

an arrangement of at least two roller presses around a central riser shaft which pneumatically transports the fine material, which is separated from the coarse material in sifters arranged below the roller presses, into an arrangement of at least two fine material settling devices.

2. The closed-circuit grinding plant as claimed in claim 1, wherein a central rod basket sifter is arranged between the central riser shaft and the fine material settling devices.

3. The closed-circuit grinding plant as claimed in claim 1, wherein the fine material settling devices are cyclones.

4. The closed-circuit grinding plant as claimed in claim 1, wherein the sifters for separating the fine material generated during the pulverization are cascade sifters.

5. The closed-circuit grinding plant as claimed in claim 1, wherein the plant is arranged to generate cement raw meal and/or cement from cement clinker.

6. A closed-circuit grinding plant for grinding coarse material into a fine material, comprising:

at least two roller presses for pulverizing the coarse material, at least one sifter located below each roller press for separating the fine material generated during the pulverization from the remaining coarse material with sifting air, at least two fine material settling devices arranged to receive fine material laden sifting air for settling the fine material from the sifting air of the sifters, and a riser shaft arranged to receive fine material which is separated from coarse material in the sifters and sifting air and to pneumatically transport the fine material into the fine material settling devices.

7. The closed-circuit grinding plant as claimed in claim 6, wherein the riser shaft is centrally located between the at least two roller presses.

8. The closed-circuit grinding plant as claimed in claim 6, further including a rod basket sifter arranged between the riser shaft and the fine material settling devices.

9. The closed-circuit grinding plant as claimed in claim 6, wherein the fine material settling devices are cyclones.

10. The closed-circuit grinding plant as claimed in claim 6, wherein the sifters for separating the fine material generated during the pulverization are cascade sifters.

* * * * *